US007528806B2

(12) United States Patent
Chang et al.

(10) Patent No.: US 7,528,806 B2
(45) Date of Patent: May 5, 2009

(54) PLASMA DISPLAY PANEL AND METHOD FOR DRIVING THE SAME

(75) Inventors: Geun-Yeong Chang, Suwon-si (KR); Tae-Kyoung Kang, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 626 days.

(21) Appl. No.: 10/952,178

(22) Filed: Sep. 29, 2004

(65) Prior Publication Data

US 2005/0073478 A1 Apr. 7, 2005

(30) Foreign Application Priority Data

Oct. 1, 2003 (KR) ..... 10-2003-0068362

(51) Int. Cl.
*G09G 3/28* (2006.01)

(52) U.S. Cl. ..... 345/68; 345/60

(58) Field of Classification Search ..... 345/60–69, 345/690; 315/169.3, 169.4, 169.5
See application file for complete search history.

(56) References Cited

U.S. PATENT DOCUMENTS 5,835,072 A * 11/1998 Kanazawa ..... 345/60
6,323,596 B1 * 11/2001 Ito et al. ..... 315/169.3
6,414,657 B1 * 7/2002 Kasahara et al. ..... 345/63
6,483,249 B2 * 11/2002 Ito et al. ..... 315/169.3
6,794,823 B2 * 9/2004 Ito et al. ..... 315/169.3
7,034,780 B2 * 4/2006 Fujita et al. ..... 345/63

FOREIGN PATENT DOCUMENTS

| | | |
|---|---|---|
| CN | 1046648 | 10/1990 |
| CN | 1188369 | 7/1998 |
| CN | 1246951 | 3/2000 |
| JP | 06030297 | 2/1994 |

* cited by examiner

*Primary Examiner*—Kevin M Nguyen
(74) *Attorney, Agent, or Firm*—H.C. Park & Associates, PLC

(57) ABSTRACT

A plasma display panel and a method for driving the same, wherein the method comprises detecting the frequency of a vertical synchronous signal, comparing the detected frequency with a reference frequency, and controlling the number of sustain pulses of each sub-field of a video signal according to a result of the comparison. According to the invention, damage to a plasma display panel driving circuit due to the input of an abnormal vertical synchronous signal may be prevented.

8 Claims, 4 Drawing Sheets

PLASMA DISPLAY PANEL AND METHOD FOR DRIVING THE SAME

CROSS REFERENCE TO RELATED APPLICATION

This application claims priority to and the benefit of Korean Patent Application No. 10-2003-0068362, filed on Oct. 1, 2003, which is hereby incorporated by reference for all purposes as if fully set forth herein.

BACKGROUND OF THE INVENTION

1. Field of the Invention

The present invention relates to a plasma display panel (PDP) and a method for driving the same, and more particularly, to a PDP that may be normally driven even when an abnormal vertical synchronous signal is input thereto.

2. Discussion of the Related Art

PDPs have been recently highlighted among flat panel displays due to their high luminance, high luminous efficiency and wide viewing angle.

The PDP uses plasma generated by gas discharge to display characters or images. The PDP may include several tens of thousands to millions of pixels arranged in a matrix format.

Generally, the PDP includes a pair of spaced glass substrates on which electrodes are formed and fluorescent materials are coated, and plasma formed in the space between the substrates.

FIG. 1 is a plan view of a conventional PDP.

As shown in FIG. 1, the PDP comprises sustain electrodes 2 and scan electrodes 6 arranged in parallel in pairs, where each pair constitutes one display line.

Address electrodes 4 are arranged orthogonally to the sustain electrodes 2 and scan electrodes 6. Discharge cells (first to last discharge cells) are formed at intersections between the address electrodes 4, which are arranged in a column direction, and the pairs of sustain electrodes 2 and scan electrodes 6, which are alternately arranged in a row direction.

Address display separating (ADS) driving is widely used as a method for driving the PDP in which the discharge cells are formed as described above.

Basically, the ADS driving method includes a reset period, an address period and a sustain period.

In detail, one frame is divided into a plurality of sub-fields, and each subfield is further divided into the reset period, the address period and the sustain period. These sub-fields are basic units of a frame, and 8 to 12 sub-fields are typically used to form one frame to express one image.

In the reset period, the state of each cell is initialized to facilitate an addressing operation on the cell.

In the address period, cells that are to display an image are selected. At this time, wall charges are formed in the selected cells due to an address discharge.

In the sustain period, a discharge occurs to display an image on the addressed (selected) cells.

Eight to 12 sub-fields per frame may be used to display a desired image (luminance) by adjusting the number of sustain pulses. The 8 to 12 sub-fields have different weights, and they are sequentially operated.

The frequency of a vertical synchronous signal ("$V_{sync}$") is a very important factor in expressing a gray scale using a plurality of sub-fields having different weights. FIG. 2 shows a waveform of the scan electrode 6 when the $V_{sync}$ is generated.

Specifically, FIG. 2 shows a waveform diagram of the scan electrode 6 in the first sub-field after inputting $V_{sync}$.

As shown in FIG. 2, when the $V_{sync}$ is input, the scan electrode 6 goes through a Ground period a, a pre-sustain period b and a ramp reset period c. A pre-sustain waveform is output in the pre-sustain period b, and a ramp erase pulse is output in the ramp reset period c. However, when the $V_{sync}$ is input when one sub-field is not finished, as in an operation such as a channel search function, the first sub-field of the scan electrode 6 is restarted in the middle of the sub-field. It is not finished. Consequently, in the worst case where the $V_{sync}$ starts at a ramp peak of an output waveform of the scan electrode 6 as shown in FIG. 3, excessive displacement current may flow in the panel, which may damage switches that are not able to withstand a high current.

A video signal typically has a $V_{sync}$ frequency period of 16.67 ms for National Television System Committee (NTSC) and 20 ms for Phase Alternate Line (PAL).

A PDP driving control circuit is adapted to receive a $V_{sync}$ of such a video signal and generate a control signal for a driving circuit by using the received $V_{sync}$ as a reference signal.

Accordingly, when a $V_{sync}$ having a normal period is input, the PDP driving control circuit performs normally. However, when a $V_{sync}$ with an abnormal period is input, the PDP driving control circuit may perform abnormally.

A $V_{sync}$ with an abnormal period may often be generated in a transient state such as changing a channel. When an abnormal $V_{sync}$ is input, a failure mode may occur as follows.

For example, where the driving state is a reset state, the PDP driving control circuit is initialized once the $V_{sync}$ with an abnormal period is input. In this case, a control signal disappears when a field effect transistor (FET) of the driving circuit is turned on, thereby causing the driving circuit to enter an abnormal state. As a result, the driving FET may be damaged due to a displacement current.

SUMMARY OF THE INVENTION

The present invention provides a plasma display panel and a method for driving the same which may provide stable operations for a PDP and may prevent damage to the PDP due to an abnormal driving signal resulting from an abnormal vertical synchronous signal.

Additional features of the invention will be set forth in the description which follows, and in part will be apparent from the description, or may be learned by practice of the invention.

The present invention discloses a method for driving a plasma display panel wherein a frequency of a vertical synchronous signal is detected, the detected frequency is compared with a predetermined reference frequency, and a number of sustain pulses is controlled according to a result of the comparison.

The present invention also discloses a plasma display panel comprising a plasma panel, a control circuit, an address driver, a sustain driver, and a scan driver.

The plasma panel includes a plurality of address electrodes arranged in a column direction, and a plurality of sustain electrodes and a plurality of scan electrodes alternately arranged in a row direction. The control circuit detects a frequency of a vertical synchronous signal, compares the detected frequency with a reference frequency, and controls a number of sustain pulses according to a result of the comparison. The address driver receives an address driving control signal from the control circuit and applies display data signals to the address electrodes. The sustain driver receives a sustain electrode driving control signal from the control circuit and applies a driving voltage to the sustain electrodes. The scan driver receives a scan electrode driving control signal from the control circuit and applies driving voltages to the scan electrodes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION

Now, preferred embodiments of the present invention will be described in detail with reference to the attached drawings.

Figure 1:
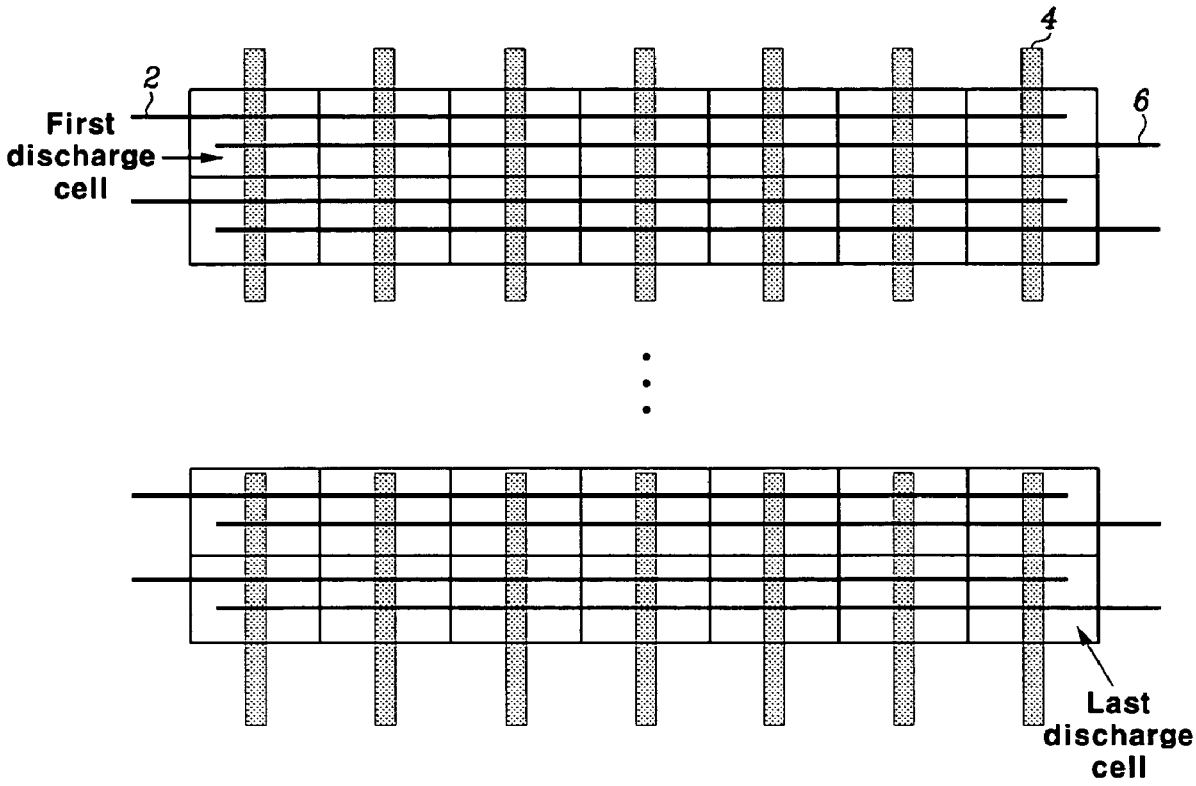
FIG.1 (Prior Art)
FIG. 1 is a plan view of a conventional PDP.
Figure 2:
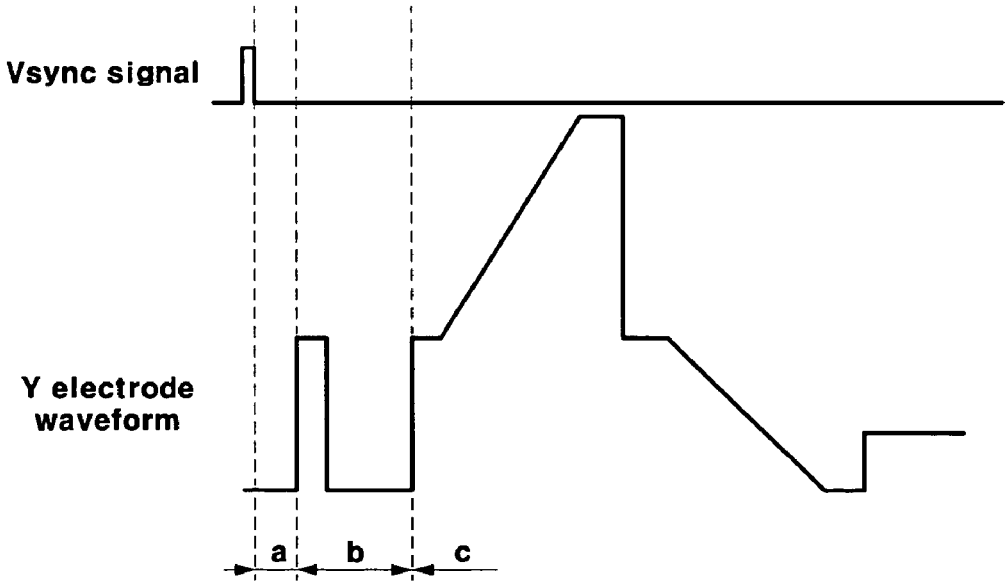
FIG.2 (Prior Art)
FIG. 2 is a waveform diagram of a scan electrode in a first sub-field after a $V_{sync}$ is input according to an example of an ADS driving method for the conventional PDP.
Figure 3:
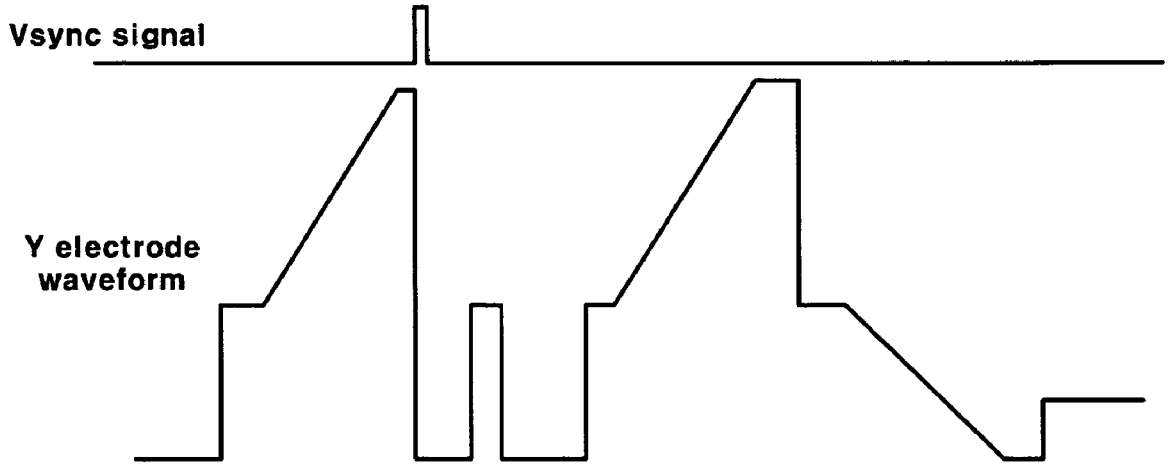
FIG.3 (Prior Art)
FIG. 3 shows a waveform diagram of a scan electrode where an abnormal $V_{sync}$ is input at a ramp peak of the scan electrode according to another example of the ADS driving method for the conventional PDP.
Figure 4:
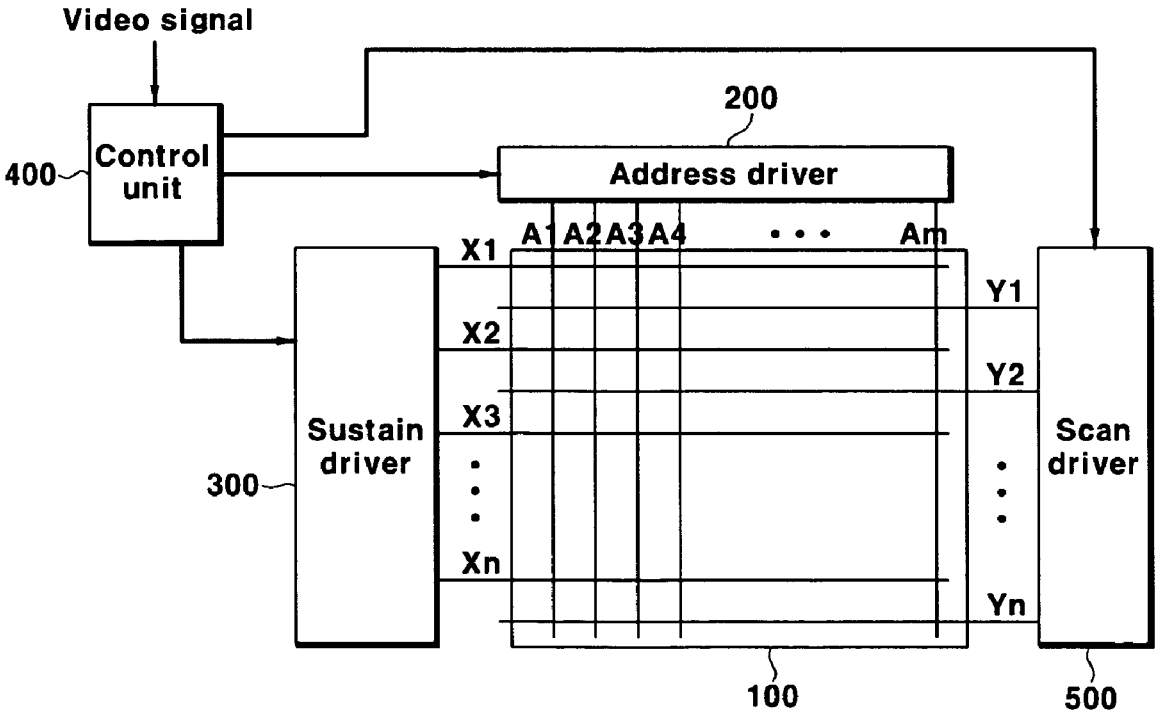
FIG. 4 shows the configuration of a PDP according to an exemplary embodiment of the present invention.

FIG. 4 shows the configuration of a PDP according to an exemplary embodiment of the present invention.

Referring to FIG. 4, the PDP according to an exemplary embodiment of the present invention comprises a plasma panel 100, an address driver 200, a sustain driver 300, a scan driver 500 and a control unit 400.

The plasma panel 100 includes a plurality of address electrodes $A_1$ to $A_m$ arranged in a column direction, and a plurality of sustain electrodes $X_1$ to $X_n$ and a plurality of scan electrodes $Y_1$ to $Y_n$ alternately arranged in a row direction.

The address driver 200 receives an address driving control signal from the control unit 400 and applies display data signals to the address electrodes $A_1$ to $A_m$ to select desired discharge cells.

The sustain driver 300 receives a sustain electrode driving control signal from the control unit 400 and applies a driving voltage to the sustain electrodes $X_1$ to $X_n$. The scan driver 500 receives a scan electrode driving control signal from the control unit 400 and applies driving voltages to the scan electrodes $Y_1$ to $Y_n$. During a sustain period, in response to the control signals from the control unit 400, the sustain driver 300 and scan driver 500 alternately apply sustain discharge voltages to the sustain electrodes $X_1$ to $X_n$ and the scan electrodes $Y_1$ to $Y_n$, respectively, to generate sustain discharges at the selected discharge cells.

The control unit 400 receives a red (R), green (G), blue (B) video signal and a vertical synchronous signal $V_{sync}$, and outputs the address driving control signal, the sustain electrode driving control signal and the scan electrode driving control signal. The control unit 400 controls signals to the address driver 200, sustain driver 300 and scan driver 500 by adjusting the number of sustain pulses applied in the sustain period of each sub-field according to a frequency variation of $V_{sync}$.

A detailed description will hereinafter be given of the control unit 400 in the PDP with reference to FIG. 5.

Figure 5:
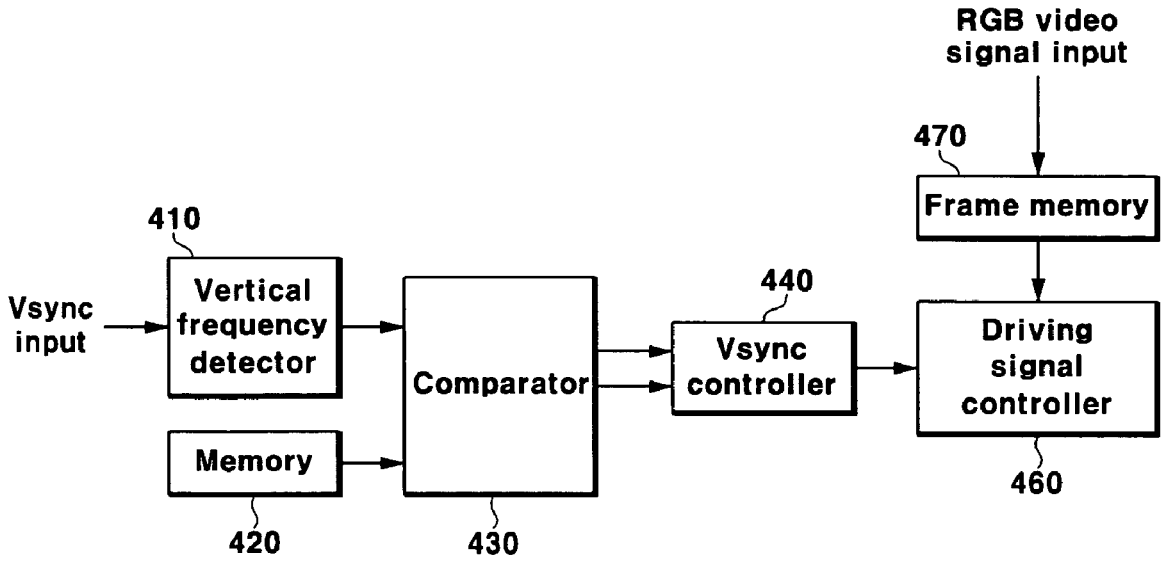
FIG. 5 is a block diagram of a control unit in FIG. 4.

FIG. 5 is a block diagram of the control unit 400 in FIG. 4.

As shown in FIG. 5, the control unit 400 includes a vertical frequency detector 410, a memory 420, a comparator 430, a $V_{sync}$ controller 440, a driving signal controller 460, and a frame memory 470.

The vertical frequency detector 410 receives a $V_{sync}$ and detects its frequency.

The memory 420 stores a reference frequency for normal operation control based on the frequency of the $V_{sync}$.

The comparator 430 compares the frequency detected by the vertical frequency detector 410 with the reference frequency stored in the memory 420.

The $V_{sync}$ controller 440 performs a normal operation without adjusting the number of sustain pulses when the frequency of the input $V_{sync}$ is between the reference frequency and an arbitrarily set frequency $f_a$. When the frequency of the $V_{sync}$ is between the set frequency $f_a$ and a second set frequency $f_b$, which is set higher than the frequency $f_a$, the $V_{sync}$ controller 440 performs a normal operation but adjusts the number of sustain pulses to stably operate the PDP. When the frequency of the $V_{sync}$ is higher than the second set frequency $f_b$, the $V_{sync}$ controller 440 ignores the $V_{sync}$ and waits for the next $V_{sync}$.

The driving signal controller 460 receives a frame of video data from the frame memory 470 and according the $V_{sync}$ controller 440 generates and outputs a driving control signal to drive the PDP by adjusting the number of sustain pulses of the video data frame.

The frame memory 470 stores video data input after gamma-correcting video data generated by digitizing the RGB video signal.

The operation of the control unit 400 will hereinafter be described in detail with reference to FIG. 6 and FIG. 7.

Figure 6:
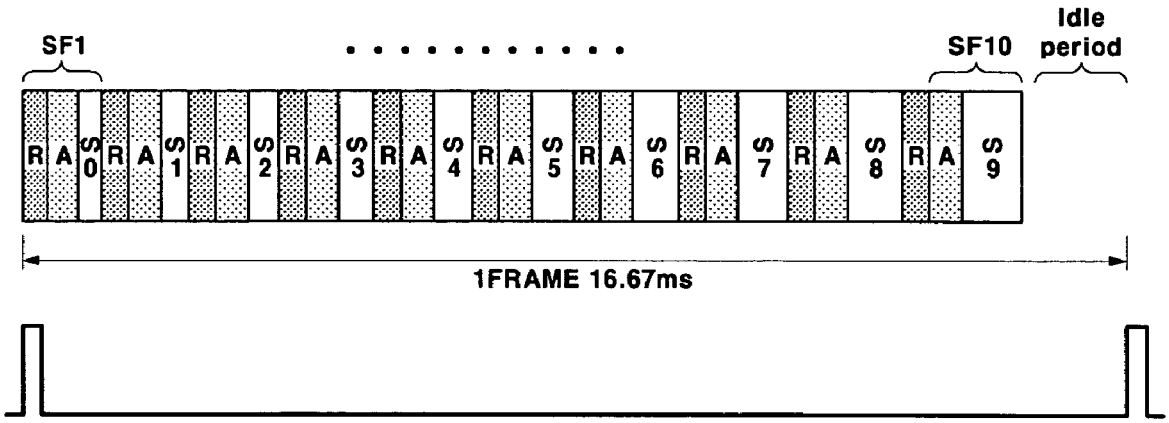
FIG. 6 shows a video signal frame when a normal $V_{sync}$ for NTSC is input, according to a first exemplary embodiment of the present invention.

FIG. 6 shows a video signal frame, when a normal $V_{sync}$ for NTSC is input, according to a first exemplary embodiment of the present invention.

Eight to 12 sub-fields are typically used to form a frame to express one image for one period of the $V_{sync}$. FIG. 6 shows an embodiment in which 10 sub-fields form one frame, but the present invention is not limited to 10 sub-fields.

A $V_{sync}$ of a normal NTSC video signal has a frequency period of 16.67 ms.

As shown in FIG. 6, when a normal $V_{sync}$ is input, a frame of a video signal input for one period (16.67 ms) of the $V_{sync}$ is composed of 10 sub-fields SF1 to SF10, and an idle period located at the end portion of the $V_{sync}$ period, to express one image.

When the normal $V_{sync}$ is input as described above, the PDP driving circuit performs a normal operation.

Figure 7:
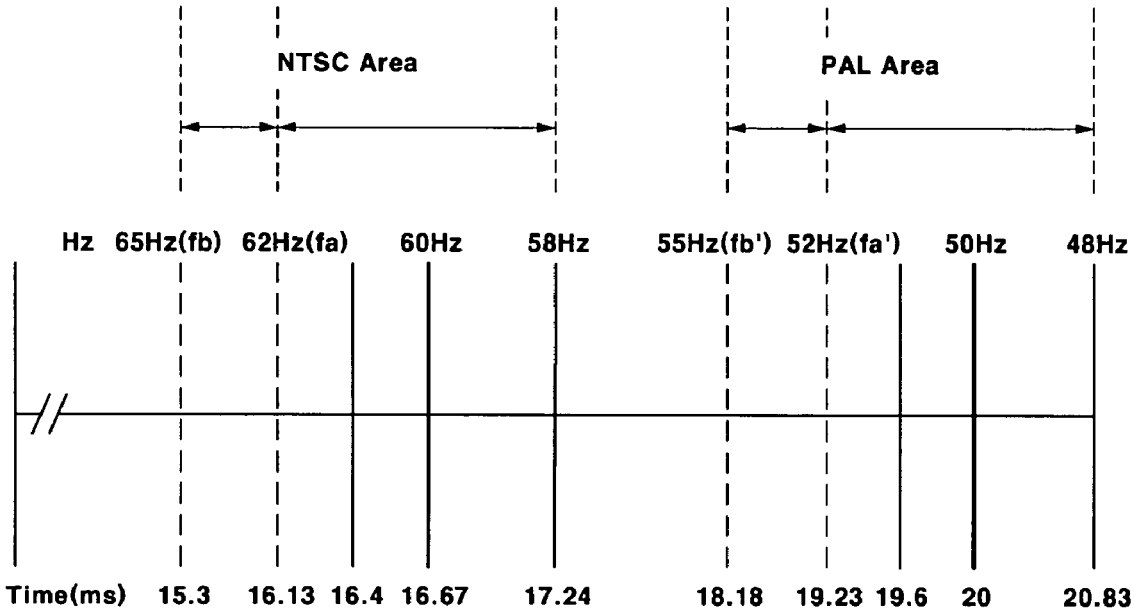
FIG. 7 shows a PDP driving method when an abnormal $V_{sync}$ is input, according to a second exemplary embodiment of the present invention.

FIG. 7 shows a PDP driving method when an abnormal $V_{sync}$ is input, according to a second exemplary embodiment of the present invention.

The NTSC utilizes a 16.67 ms $V_{sync}$ frequency period and a 60 Hz reference frequency, and the PAL utilizes a 20 ms $V_{sync}$ frequency period and a 50 Hz reference frequency. These values are stored in the memory 420, and will be used in the below description.

The arbitrarily set frequencies $f_a$, $f_{a'}$, $f_b$ and $f_{b'}$ discussed in the below description have illustrative values, and they are not limited thereto.

When the frequency of a $V_{sync}$ input in the NTSC is between the reference frequency of 60 Hz and the arbitrarily set frequency $f_a$ (for example, fa=62 Hz), the $V_{sync}$ controller 440 normally operates the PDP driving circuit without adjusting the number of sustain pulses of a frame of an externally input video signal. In other words, where the input $V_{sync}$ has a frequency between 60 Hz and 62 Hz, the PDP driving circuit is normally operated and the number of sustain pulses is not adjusted.

When the frequency of the $V_{sync}$ input in the NTSC is between the set frequency $f_a$ (fa=62 Hz) and the set frequency $f_b$ (for example, $f_b$=65 Hz), which is set higher than the frequency $f_a$, the $V_{sync}$ controller 440 performs a normal operation but adjusts the number of sustain pulses of the frame of the input video signal. At this time, the $V_{sync}$ controller 440 adjusts the position of the idle period depending on the adjusted number of sustain pulses. Then the $V_{sync}$ has a frequency margin corresponding to the idle period.

In detail, where the input $V_{sync}$ has a frequency between the frequency $f_a$, which is set to perform a normal display operation without adjusting the number of sustain pulses, and the frequency $f_b$, which is set slightly higher than the frequency $f_a$, the $V_{sync}$ controller 440 performs the normal display operation by receiving the frame of the input RGB video signal from the frame memory 470 and adjusting the number of sustain pulses of each sub-field of the frame. In other words, the $V_{sync}$ controller 440 limits the number of sustain pulses of the video signal frame to a value that may allow stable operation of the PDP in the sustain period, and performs the idle period at the end portion of the $V_{sync}$ period. For example, when the input $V_{sync}$ has a frequency between 62 Hz and 65 Hz, the $V_{sync}$ controller 440 adjusts the number of sustain pulses of each sub-field and the position of the idle period so that the PDP driving circuit may be normally operated.

When the $V_{sync}$ input in the NTSC has a higher frequency than the frequency $f_b$, the PDP driving circuit may not be normally operated. As a result, in this case, the $V_{sync}$ controller 440 ignores the input $V_{sync}$ and secures a time required for normal driving when a driving control signal is generated.

In the same manner as in the NTSC, the $V_{sync}$ controller 440 performs a control operation to normally operate the PDP driving circuit according to an abnormal $V_{sync}$ input in the PAL. However, for the PAL, a $V_{sync}$ of a video signal has a 20 ms frequency period and a 50 Hz reference frequency. When the frequency of a $V_{sync}$ input in the PAL is between the 50 Hz reference frequency and the arbitrarily set frequency $f_{a'}$ (for example, $f_{a'}$=52 Hz), the $V_{sync}$ controller 440 normally operates the PDP driving circuit without adjusting the number of sustain pulses of a frame of an externally input video signal. In other words, where the input $V_{sync}$ has a frequency between 50 Hz and 52 Hz, the PDP driving circuit is normally operated without adjusting the number of sustain pulses.

When the frequency of the $V_{sync}$ input in the PAL is between the set frequency $f_{a'}$ ($f_{a'}$=52 Hz) and the set frequency $f_{b'}$ (for example, $f_{b'}$=55 Hz), which is set higher than the frequency $f_{a'}$, the $V_{sync}$ controller 440 normally operates the PDP driving circuit and adjusts the number of sustain pulses of the frame of the input video signal. The $V_{sync}$ controller 440 limits the number of sustain pulses of the video signal frame to a value that may allow a stable operation of the PDP in the sustain period, and locates the idle period at the end portion of the $V_{sync}$ period.

When the $V_{sync}$ input in the PAL has a higher frequency than the frequency $f_{b'}$, the PDP driving circuit may not be normally operated because a normal RGB video signal is not inputted. As a result, in this case, the $V_{sync}$ controller 440 ignores the input $V_{sync}$ and secures a time required for normal driving when a driving control signal is generated.

As noted in the above description, according to exemplary embodiments of the present invention, damage to a PDP driving circuit due to the input of an abnormal vertical synchronous signal may be prevented. Therefore, a PDP may be driven normally and stably.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel (PDP) according to a vertical synchronous signal, comprising:

detecting a frequency of the vertical synchronous signal;

comparing the detected frequency with a reference frequency; and controlling a number of sustain pulses according to a result of the comparison, wherein when comparing the detected frequency, if the detected frequency is between the reference frequency and a first set frequency, the number of sustain pulses of a frame of an input video signal is not adjusted.

2. The method of claim 1, wherein when comparing the detected frequency, if the detected frequency is between the first set frequency and a second set frequency, the number of sustain pulses of the frame of the input video signal is adjusted and a position of an idle period of the frame is adjusted;

wherein the second set frequency is higher than the first set frequency.

3. The method of claim 2, wherein the number of sustain pulses of the frame of the input video signal is adjusted to a value allowing a stable operation of the PDP; and wherein the idle period is positioned at an end portion of a period of the vertical synchronous signal.

4. The method of claim 2, wherein when comparing the detected frequency, if the detected frequency is higher than the second set frequency, the vertical synchronous signal is ignored and time for generating a stable driving waveform is obtained.

5. A plasma display panel (PDP), comprising:

a plurality of address electrodes arranged in a column direction, and a plurality of sustain electrodes and a plurality of scan electrodes alternately arranged in a row direction;

a control circuit for detecting a frequency of a vertical synchronous signal, comparing the detected frequency with a reference frequency, and controlling a number of sustain pulses according to a result of the comparison;

an address driver for receiving an address driving control signal from the control circuit, and applying display data signals to the plurality of address electrodes;

a sustain driver for receiving a sustain electrode driving control signal from the control circuit, and applying a driving voltage to the plurality of sustain electrodes; and a scan driver for receiving a scan electrode driving control signal from the control circuit, and applying a driving voltage to the plurality of scan electrodes, wherein when comparing the detected frequency, if the detected frequency is between the reference frequency and a first set frequency, the control circuit does not adjust the number of sustain pulses of a frame of an input video signal.

6. The PDP of claim 5, wherein the control circuit includes:

a frame memory for storing a frame of an RGB video signal;

a memory for storing a reference frequency of the vertical synchronous signal;

a vertical frequency detector for detecting the frequency of the vertical synchronous signal;

a comparator for comparing the frequency detected by the vertical frequency detector with the reference frequency stored in the memory;

a vertical synchronous signal controller for controlling the number of sustain pulses of a video signal frame or ignoring the vertical synchronous signal, according to a result of the comparison of the comparator; and a driving signal controller for generating and outputting a driving control signal according to a result of the control of the vertical synchronous signal controller.

7. The PDP of claim 6, wherein the vertical synchronous signal controller adjusts the number of sustain pulses and a position of an idle period of the frame when the result of the comparison of the comparator indicates that the vertical synchronous signal has a frequency between the first set frequency and a second set frequency;

wherein the second set frequency is higher than the first set frequency.

8. The PDP of claim 7, wherein the vertical synchronous signal controller ignores the vertical synchronous signal and secures a time required for generation of a stable driving waveform when the result of the comparison of the comparator indicates that the vertical synchronous signal has a frequency higher than the second set frequency.

* * * * *